US008985750B2

(12) United States Patent
Fabre et al.

(10) Patent No.: US 8,985,750 B2
(45) Date of Patent: Mar. 24, 2015

(54) INK JET PRINTING PROCESS USING GAS WITH MOLAR MASS LOWER THAN AIR DURING INK DEPOSITION

(75) Inventors: Norbert Fabre, Lavaur (FR); Véronique Conedera, Toulouse (FR); Paul Fadel, Toulouse (FR); Fabien Mesnilgrente, Toulouse (FR)

(73) Assignee: Centre National de la Recherche Scientifique, Paris (FR)

( * ) Notice: Subject to any disclaimer, the term of this patent is extended or adjusted under 35 U.S.C. 154(b) by 0 days.

(21) Appl. No.: 13/993,405

(22) PCT Filed: Nov. 24, 2011

(86) PCT No.: PCT/IB2011/055285

§ 371 (c)(1),
(2), (4) Date: Aug. 26, 2013

(87) PCT Pub. No.: WO2012/080877

PCT Pub. Date: Jun. 21, 2012

(65) Prior Publication Data

US 2013/0321533 A1 Dec. 5, 2013

(30) Foreign Application Priority Data

Dec. 13, 2010 (FR) ..... 10 04847

(51) Int. Cl.

| | |
|---|---|
| ***B41J 2/09*** | (2006.01) |
| ***B41J 2/165*** | (2006.01) |
| ***B41J 2/14*** | (2006.01) |
| ***B41J 2/02*** | (2006.01) |
| ***B41J 2/04*** | (2006.01) |
| ***B41J 11/00*** | (2006.01) |

(52) U.S. Cl.

CPC .... *B41J 2/14* (2013.01); *B41J 2/02* (2013.01); *B41J 2/04* (2013.01); *B41J 11/0015* (2013.01); *B41J 2202/02* (2013.01)

USPC ..... 347/77; 347/25

(58) Field of Classification Search

USPC ..... 3/17, 20, 21, 25, 37, 77, 83

See application file for complete search history.

(56) References Cited

U.S. PATENT DOCUMENTS

| | | | | |
|---|---|---|---|---|
| 4,097,872 | A * | 6/1978 | Giordano et al. | 347/21 |
| 6,081,281 | A | 6/2000 | Cleary et al. | |
| 6,390,618 | B1 * | 5/2002 | Wotton et al. | 347/102 |
| 6,588,889 | B2 * | 7/2003 | Jeanmaire | 347/77 |
| 6,623,097 | B2 * | 9/2003 | Okada et al. | 347/21 |
| 7,413,293 | B2 * | 8/2008 | Jeanmaire | 347/77 |
| 2002/0041302 | A1 | 4/2002 | Okada et al. | |
| 2008/0206472 | A1 | 8/2008 | Tanaka et al. | |

FOREIGN PATENT DOCUMENTS

| | | |
|---|---|---|
| FR | 2 913 632 | 9/2008 |

* cited by examiner

*Primary Examiner* — Anh T. N. Vo
(74) *Attorney, Agent, or Firm* — Clark & Brody

(57) ABSTRACT

The invention relates to an ink jet device and to an associated method. Said device (1) comprises a chamber (60) comprising at least one ink jet head (10), an inlet (66) for a gas having a lower molar mass than air, and at least one outlet (21) for said gas, said head (10) being arranged in the chamber (60) in such a way that the gas can be injected around the head (10) and removed from the chamber along with the ink supplied by the head.

5 Claims, 4 Drawing Sheets

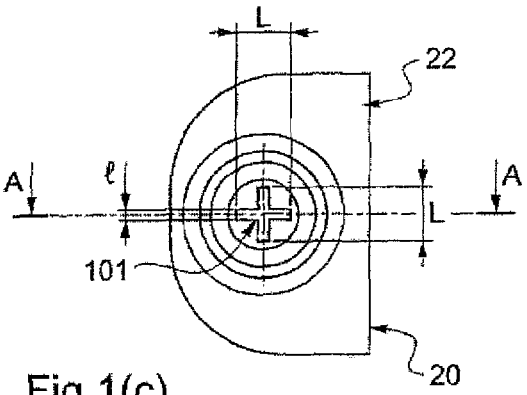
Fig.1(c)
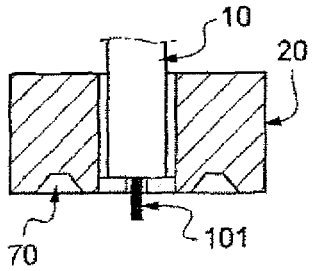
Fig.1(d)
(Cross section A-A)
Fig.2
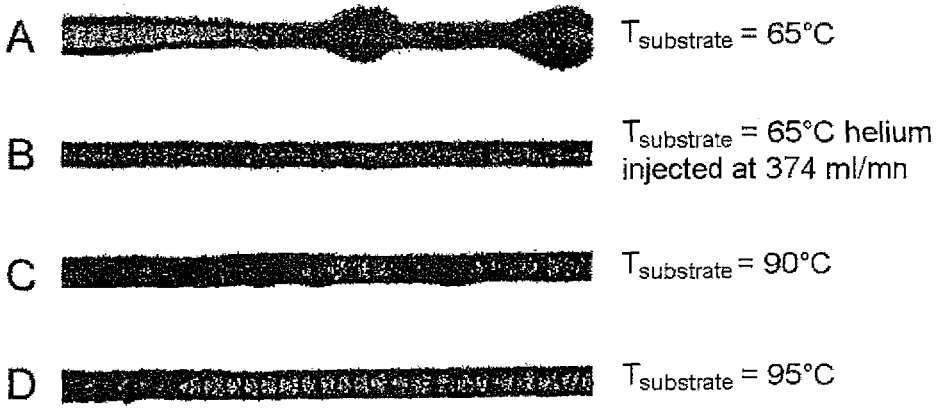

A
F1
60a
203

20'
110
65
82
50
81
80
60'
66
1'
63
201
24
60b
40
30
10
F
F
23'
230'
201
22
231'
21'
70
F
injected gas
105
101'
100
104
106

Fig.3(b)
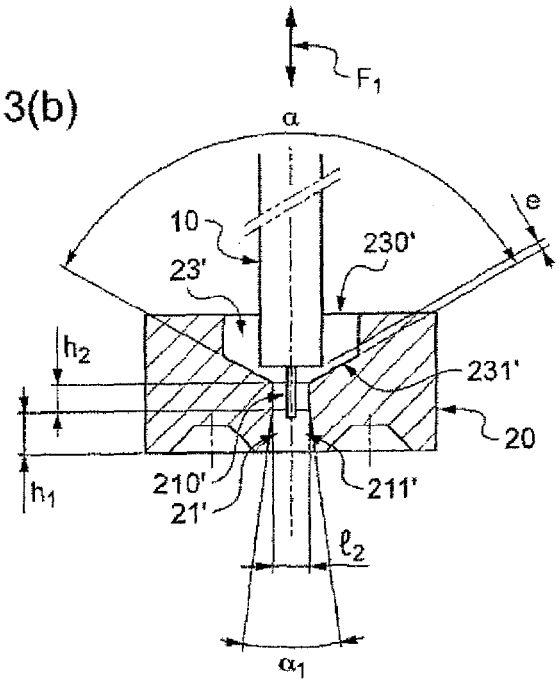
Fig.4
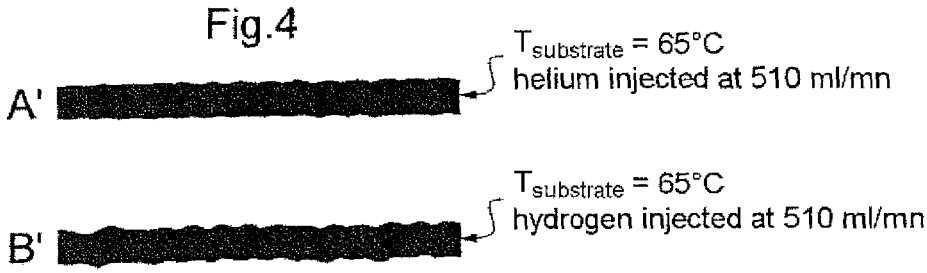
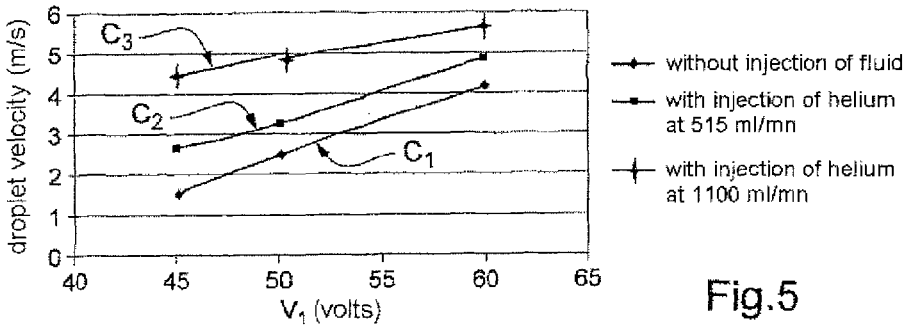
Fig.5

INK JET PRINTING PROCESS USING GAS WITH MOLAR MASS LOWER THAN AIR DURING INK DEPOSITION

The present invention relates to inkjet printing techniques.

Inkjet printing techniques are especially used in the field of printers and, more generally, in graphic application.

At the present time it is desired to apply inkjet printing techniques to fields other than graphic application, such as, for example, to microtechnology and/or nanotechnology.

This is because known inkjet printing devices are inexpensive and reliable. It would therefore be desirable to be able to benefit from these advantages in fields other than that of graphic design.

However, certain applications have specific needs that known inkjet printing devices are not able to meet.

Thus, in the nanotechnology field, the use of known inkjet printing devices is limited by problems relating to the resolution of the inkjet printing technique with respect to the resolution of the techniques, such as photolithography, conventionally used in this field. Specifically, known inkjet printing devices do not allow ink to be deposited on a substrate with a print quality comparable in precision to that obtained with the techniques conventionally used in the field of nanotechnology.

Similar problems are generally encountered in the microtechnology field.

One objective of the invention is to provide an inkjet printing device capable of obtaining, in particular in fields other than graphic application, a higher resolution than existing inkjet printing devices.

In particular, one objective of the invention is to provide such an inkjet printing device for microtechnology and/or nanotechnology applications.

Another objective of the invention is to provide such an inkjet printing device, said device being inexpensive and reliable.

To achieve at least one of these objectives, the invention provides an inkjet printing device comprising a chamber containing at least one inkjet head, an inlet orifice for a gas having a molar mass lower than the molar mass of air, and at least one outlet orifice for this gas, said head being placed in the chamber such that the gas can be injected around the head and ejected out of the chamber with the ink delivered from the head.

The device will possibly have other technical features, whether in isolation or in combination:

- a member is provided to support the inkjet head, said supporting member comprising a means for controlling its temperature, for example a resistive heater or a heating circuit;
- the supporting member comprises at least one channel for removing fluid;
- a means is provided for controlling the temperature of a target surface on which the ink delivered from the inkjet head is intended to be deposited;
- the chamber is funnel-shaped, in order to increase the velocity of the gas around the inkjet head; and
- a means is provided for controlling the gas flow rate.

To achieve at least one of these objectives, the invention also provides an inkjet printing process for printing on a target surface, comprising the following steps:

- depositing ink on the target surface with at least one inkjet head placed in a chamber, said ink comprising a solvent that is liable to evaporate when it makes contact with the target surface; and

- injecting a gas having a molar mass lower than the molar mass of air into the chamber, said head being placed in this chamber so that the gas thus injected flows around the head and is then ejected out of the chamber with the ink delivered from the head.

The process will possibly have other technical features, whether in isolation or in combination:

- the temperature of the target surface is controlled;
- the gas comprises an additive capable of modifying the contact angle between the ink deposited on the target surface and this target surface;
- the gas comprises an additive capable of functionalizing particles contained in the ink after evaporation of the solvent from the ink;
- the gas flow rate is controlled; and
- the gas ejected out of the chamber increases the velocity of the ink drops via a driving effect.

Other features, aims and advantages of the invention will become apparent from the following detailed description given with reference to the following figures:

FIG. 1(*b*) is a partial view from below of the device shown in FIG. 1(*a*);

FIG. 1(*c*) is a schematic showing, from below, the orifice of the device shown in FIG. 1(*a*);

FIG. 1(*d*) is a schematic showing a view of the cross section A-A of the part of the device shown in FIG. 1(*c*);

FIG. 2 shows various lines of ink printed on a substrate with the device shown in FIGS. 1(*a*) to 1(*d*);

FIG. 3(*b*) is a schematic of the device shown in FIG. 3(*a*), illustrating an enlarged view of the inkjet head;

FIG. 4 shows various lines of ink printed on a substrate with the device shown in FIGS. 3(*a*) and 3(*b*), with injection of helium and hydrogen, for the same substrate temperature; and FIG. 5 shows the variation in the velocity of the ink drops delivered from an inkjet head as a function of the voltage applied to a piezoelectric actuator of this head.

Figure 1A:
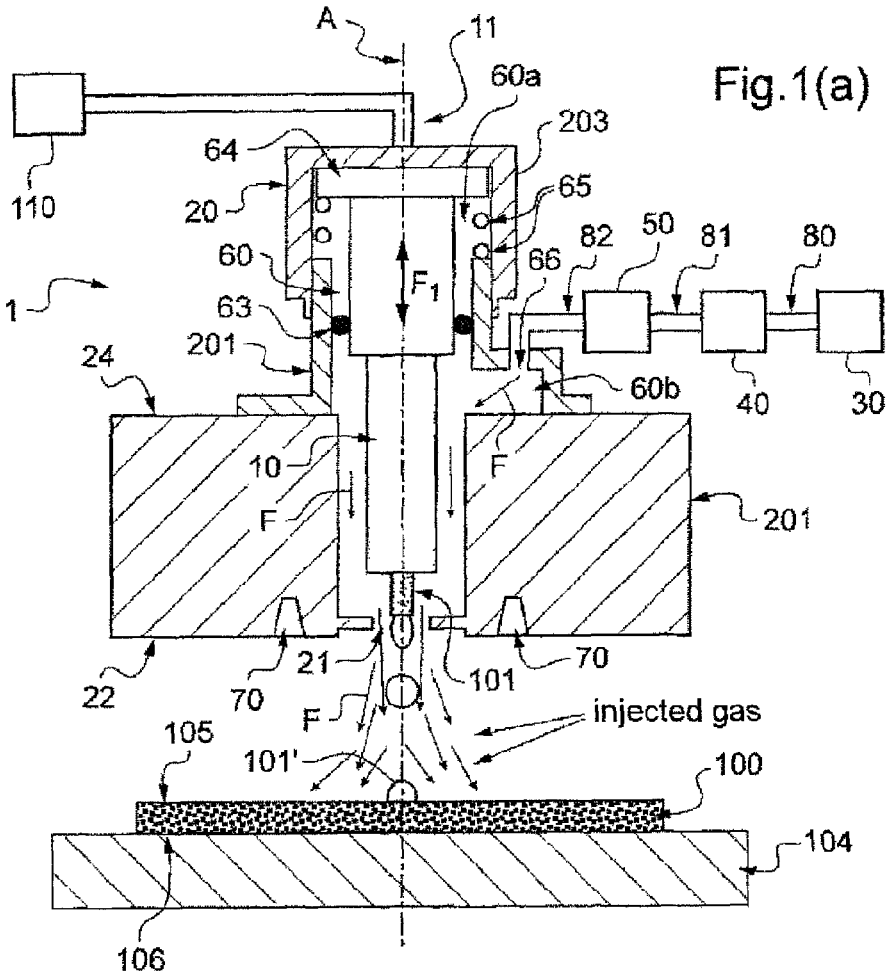
FIG. 1(*a*) is a schematic cross-sectional view of a first embodiment of an inkjet printing device according to the invention.
Figure 1B:
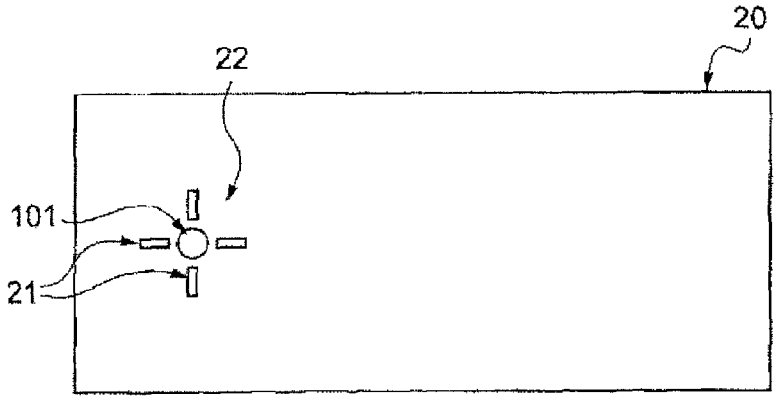

A first embodiment is shown in FIGS. 1(*a*) to 1(*d*).

The inkjet printing device 1 comprises a reservoir 110 of ink, which ink contains a solvent that is liable to evaporate when it makes contact with a substrate 100 on which this ink is intended to be deposited. It also comprises an inkjet head 10, one end of which is fluidically connected to the reservoir 110 of ink via a duct 11.

The other end of the inkjet head 10 terminates in an ink ejecting nozzle 101, placed facing the target surface 100.

The inkjet head 10 is actuated by a system (not shown) allowing a succession of independent ink drops to be generated. In particular, this may be what is called a "drop on demand" piezoelectric system allowing drops to be generated on demand by way of suitable choice of the control amplitude and frequency of this system, thereby allowing drop size and production rate to be controlled.

However, an inkjet head allowing other forms of drop to be generated, especially a spray of drops, could be envisioned.

The inkjet printing device 1 also comprises a chamber 60 in which the inkjet head is housed.

This chamber GO is defined by the sides of a member 20 that supports the inkjet head 10, this supporting member 20 in this case being made up of a number of parts.

Specifically, this supporting member 20 comprises a supporting body 201, a vertical wall 202 that is mounted on the upper side 24 of the supporting body 201, and a cover 203 mounted on the vertical wall 202.

One end of the inkjet head 10 is mounted on the cover 203 and the weight of this head 10 is then transmitted from the cover 203 to the vertical wall 202 and then to the supporting body 201, which body is mounted on a frame (not shown).

The inkjet head 10 thus passes through the supporting member 20 and extends into the chamber 60 and in particular into the supporting body 201, the latter containing a housing 23 for this purpose.

The chamber 60 is separated into two parts 60*a*, 60*b* sealed from each other by virtue of an O-ring 63 placed both around the inkjet head 10 and against the internal part of the vertical wall 202.

The cover 203 may be movably mounted relative to the vertical wall 202, in order to permit this cover to move in translation relative to the vertical wall 202. This movement occurs along the longitudinal axis A of the inkjet head 10. It is shown by the arrow $F_1$ in the appended figures.

This allows the position of the inkjet head 10 relative to the target surface 100 to be controlled.

In this case, the upper part 60*a* of this chamber 60 advantageously comprises an elastic means 65, such as a spring, placed between a plate 64, mounted on the internal part of the cover 203, and the vertical wall 202. This spring 65 allows a force that is liable to be exerted on the upper part of the cover 203 to be opposed, thereby making it possible for the inkjet head 10 to return to a reference position.

As a variant, it is possible to envision a simpler device in which the position of the inkjet head 10 cannot be adjusted.

Moreover, the lower part 60*b* of the chamber 60 comprises an inlet orifice 66 for a gas and an outlet orifice 21 for this gas, the head 10 being arranged in the chamber 60 so that the gas can be injected around the head 10 and ejected out of the chamber with the ink delivered from the head.

The outlet orifice 21 is formed in the lower wall 22 of the supporting body 201, this lower wall 22 lying opposite the upper wall 24 of this supporting body 201.

The inlet orifice 66 of the chamber 60 is connected to a reservoir 30 containing a pressurized gas, by way of various means.

Specifically, the gas reservoir 30 is connected by a duct 80 to a means 40, such as a regulator, for setting the gas in motion.

The gas contained in the reservoir has a molar mass lower than the molar mass of air. It will be recalled that the molar mass of air is 29 g/mol.

Thus, the gas contained in the reservoir may be qualified a "light" gas. This gas may for example be helium or hydrogen.

The diffusion coefficient of the vapor of the solvent of the ink in the gas contained in the reservoir 30, because of the molar mass of said gas, is higher than the diffusion coefficient of the same solvent vapor in air. This may be observed whatever the nature of the solvent, the nature of the solvent having a secondary effect on the value of the diffusion coefficient of the vapor of the solvent in the gas in question.

As for the regulator 40 it is connected to a flow meter 50 by way of a duct 81. Lastly, the flow meter 50 is connected by a duct 82 to the inlet orifice 66 leading to the lower part 60*b* of the chamber 60.

The flow meter 50 allows the flow rate of gas delivered from the gas reservoir 30 to be measured and allows this flow rate to be set to a value chosen by the operator.

Other means of setting the gas in motion could be employed.

After it has entered the lower part 60*b* of the chamber 60, the gas flows along the inkjet head 10, in the housing 23 of the supporting body 201, before exiting via the orifice 21 formed in the lower wall 22 of the supporting body 201.

This gas is then sprayed against the target surface 100 at the same time as the ink delivered from the nozzle 101 of the inkjet head 10. This gas therefore flows around and travels in the same direction as the ink drops delivered from the nozzle 101, the ink being intended to be deposited on the target surface 100.

The path travelled by the gas delivered from the reservoir is shown by the arrows F.

In operation, for microtechnology or nanotechnology applications, the fluid contained in the volume located between the lower side 22 of the supporting body 201 and the upper side 105 of the target surface 100 is saturated with a fluid comprising, on the one hand, the gas coming from the reservoir 30, and on the other hand, solvent vapor coming from the ink.

Specifically, the ink used in these applications may be formed by a mixture of a powder, microparticles or nanoparticles depending on the circumstances, and a solvent. In these applications, the target surface 100 is generally a substrate.

Thus, when a drop 101' of ink is deposited on the substrate 100, the solvent contained in the drop evaporates in order to leave only the desired deposit, the solvent vapor then mixing with the fluid contained in the volume located between the supporting member 20 and the substrate 100.

The rate at which the solvent evaporates is an important factor affecting whether the resolution of the deposit is improved.

It has been demonstrated, as will be explained below, that the injection of a gas having a molar mass lower than the molar mass of air allows the resolution of this deposit to be improved.

The device 1 advantageously comprises a means 104 for heating the substrate 100 to a desired temperature. This means 104 will generally be placed on the lower side 106 of the substrate 100, opposite what is called the upper side 105 of said substrate 100, on which upper side the ink 101' is deposited. Specifically, heating the substrate 100 accelerates evaporation of the solvent.

The orifice 21 may have a cross shape, the longitudinal axis of the nozzle 101 then advantageously passing through the center of this orifice 21, as is shown in FIGS. 1(*b*) and 1(*c*).

Advantageously, the supporting member, and more precisely the supporting body 201, also comprises at least one, for example circular, channel 70 opening into the lower wall of the supporting body 201, allowing turbulence in the fluid contained in the volume located between the supporting body 201 and the substrate 100 to be reduced.

This channel 70 improves the quality of the deposit produced on the substrate 100 especially enabling quality deposits to be produced with wider ranges of flow rates of gas coming from the gas reservoir 30. Other means for limiting this turbulence may be provided.

Lastly, the supporting body 201 generally comprises a heating means (not shown) with which it is possible to control the temperature of said supporting body 201, and therefore that of the nozzle 101, in order to influence the size of the ink drops delivered from the nozzle 101. This heating means may be a resistive heater, a circuit in which a fluid heated to the desired temperature is able to flow, or any other means capable of fulfilling this function.

The device 1 according to the invention allows the resolution of the ink deposit obtained on the substrate 100 to be improved relative to known inkjet printing devices.

Specifically, the Applicant has carried out tests demonstrating the benefits of the invention. The results of these tests are shown in FIG. 2.

FIG. 2 shows four lines A, B, C and D of ink deposited on the substrate substrate 100 using the device described with reference to FIGS. 1(*a*) to 1(*c*), under partially different test conditions.

For the lines A, B, C and D, the following experimental conditions were the same.

The ink was formed by mixing zinc oxide nanoparticles in a concentration by weight of 10% in the solvent, namely ethylene glycol, and a given amount of ink was deposited.

The ejection nozzle used had a diameter of 50 μm and said nozzle was heated to a temperature of 47° C.

A line was formed by depositing drops in succession every 50 μm.

The inkjet head was actuated by a piezoelectric actuator, at a voltage $V_1$=35 volts.

The nozzle was moved relative to the substrate at a speed of 450 μm/s.

The drops were delivered from the nozzle 101 with a velocity of 1.3 m/s. In order to determine this velocity, a stroboscopic detector was integrated into the device 1.

The substrate 100 used had a contact angle, measured beforehand with a drop of water, of 40°.

The orifice 21 was cross-shaped with a length L=5 mm and a width 1=1 mm, the parameters L and 1 being shown in FIG. 1(*c*). This orifice 21 received at its center the nozzle 101 the outside diameter of which was about 500 μm.

Lastly, the distance between the nozzle 101 and the substrate 100 was about 1 mm.

In contrast, the tests differed in the temperature of the substrate and/or in the presence or absence of fluid coming from the gas reservoir 30.

Thus, line A corresponds to deposition of the ink on a substrate at a temperature $T_{substrate}$=65° C., without injection of fluid coming from the gas reservoir 30. Line B corresponds to deposition of the ink on a substrate at a temperature $T_{substrate}$=65° C., with injection of helium coming from the gas reservoir 30 with a flow rate of 374 ml/mn. Line C corresponds to deposition of the ink on a substrate at a temperature $T_{substrate}$=90° C., without injection of gas coming from the gas reservoir 30. Line D corresponds to deposition of the ink on a substrate at a temperature $T_{substrate}$=95° C., without injection of gas coming from the gas reservoir 30.

Line A was not straight and contained regions in which the ink had spread because the temperature (65° C.) of the substrate 100 was too low preventing the solvent from evaporating quickly enough. As a result, the ink had a tendency, in certain regions, to spread over the substrate 100.

In contrast, line B was straight and very uniform, and moreover its width was measured to be 56 μm, for a substrate 100 at an identical temperature (65° C.).

The beneficial influence of injecting helium into the volume formed between the supporting member 20 and the substrate 100 may be noted by comparing lines A and B.

This beneficial influence is due to the fact that the diffusion coefficient of the vapor of the solvent, in this case ethylene glycol vapor, in helium is higher than the corresponding coefficient in air. This is due to the lower molar mass of helium so that a result of the same nature would be obtained with any other type of solvent.

Moreover, the inventors also consider this beneficial influence to be due to the velocity of the gas, in this case helium, which blows away the solvent vapor surrounding the ink deposited on the substrate.

After having carried out the tests corresponding to lines A and B, a number of tests were carried out without injecting helium into the volume located between the supporting member 20 and the substrate 100, the temperature of the substrate 100 being increased 5° C. each time, in order to identify the substrate temperature above which it was possible to achieve approximately the same deposition quality as obtained with the test having led to line B.

Thus, lines C and D show the results obtained, in the absence of helium injection into the volume located between the supporting member 20 and the substrate 100, for substrate temperatures of 90° C. and 95° C., respectively.

Line C deposited on the substrate was relatively straight and had a width of about 70 μm.

Line D was a little less uneven than line C but contained rings that made the deposit nonuniform. The width of line D was also about 70 μm.

At temperatures strictly below 90° C., evaporation of the solvent contained in the ink was too slow, so that the line of ink deposited on the substrate was not straight. Moreover, at temperatures strictly above 95° C., evaporation of the solvent contained in the ink was too fast and the quality of the deposit was unacceptable.

From these tests, it is therefore deduced that injecting helium into the volume located between the supporting member 20 and the substrate 100 makes it possible to obtain a better resolution (deposited line width of 56 μm) than the resolution liable to be obtained in the absence of helium injection (line width of about 70 μm), while simultaneously allowing the heating temperature of the substrate to be decreased by 25° C. to 30° C.

An additional test was also carried out with hydrogen replacing helium, the hydrogen flow rate and the substrate temperature being identical to the test carried out with helium and the other test conditions remaining the same and conforming to the conditions given above.

This test showed that hydrogen enabled a deposition quality comparable to that obtained with helium to be achieved. In particular, the line deposited under these conditions with hydrogen was straight and had a width of about 56 μm.

Figure 3A:
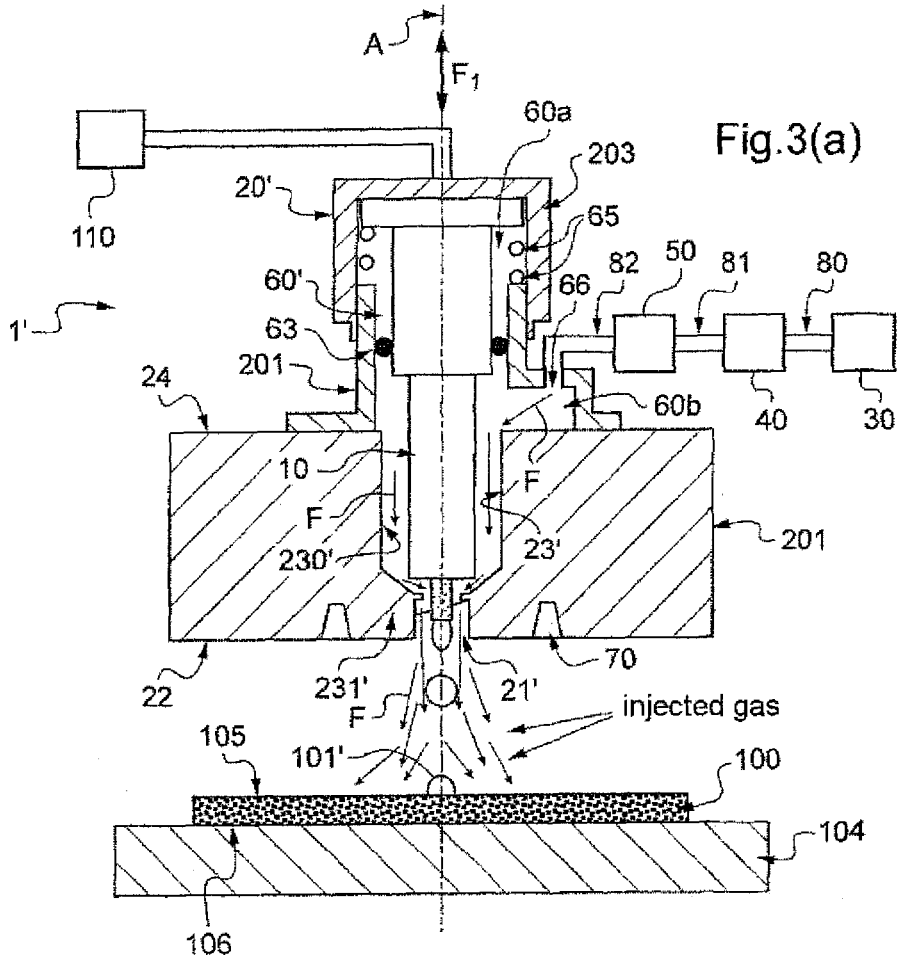
FIG. 3(*a*) is a schematic cross-sectional view of a second embodiment of an inkjet printing device according to the invention.

A second embodiment is shown in FIGS. 3(*a*) and 3(*b*).

In the second embodiment, the device 1' differs from the device 1 of the first embodiment in that the shape of the sidewalls of the housing 23' and therefore the shape of the housing 23' itself, produced in the supporting member 20', is different.

Thus, the shape of the chamber 60' is also modified.

This is also the case for the shape of the orifice 21'.

Specifically, the housing 23' produced in the supporting member 20' has a funnel shape. This shape allows a Venturi effect to be generated between the inkjet head and the walls of the housing 23'.

The funnel ends in the orifice 21' which therefore has, when observed from below, a circular shape in which the nozzle 101 of the inkjet head 10 is located.

Example shapes for the housing 23' and orifice 21' are shown in greater detail in FIG. 3(*b*).

The housing 23' comprises a cylindrical part 230', under which another part 231', taking the form of a narrowing, is provided. The orientation of the walls in this part 231' where the housing 23' narrows may be defined, in the vertical cross-sectional plane of FIG. 3(*b*) by an angle a, for example of 120°. This angle a is chosen to limit turbulence.

As for the orifice 21', it has a first cylindrical part 210', of diameter $l_2$ and height $h_2$, under which another part, having a conical shape, of height $h_1$, is located. The angle $\alpha_1$ made between the walls of this conical part, defined in the vertical cross-sectional plane of FIG. 3(*b*), is advantageously chosen to limit turbulence. However, the orifice 21' could have a simpler shape, it could, for example, be completely cylindrical.

The other features of this second embodiment V of the device are the same as the features described for the first embodiment 1 of the device, identical references in the two embodiments relate to the same elements.

The Applicant has carried out tests allowing the benefit of this second embodiment of the invention to be demonstrated. The results of these tests are shown in FIG. 4.

FIG. 4 shows two lines of ink A' and B' deposited on a substrate 100 with the device 1' described with reference to FIGS. 3(*a*) and 3(*b*), under partially different test conditions.

For the two lines A' and B' the following experimental conditions were the same.

The ink was formed by mixing zinc oxide nanoparticles in a concentration by weight of 10% in the solvent, namely ethylene glycol, and a same amount of ink was deposited.

The ejection nozzle used had a diameter of 50 μm and said nozzle was heated to a temperature of 47° C.

The line was formed by depositing drops in succession every 50 μm.

The inkjet head was actuated by a piezoelectric actuator, at a voltage $V_1$=50 volts.

The nozzle was moved relative to the substrate at a speed of 450 μm/s.

The drops were delivered from the nozzle 101 with a velocity of 3.2 m/s. This velocity was measured using a stroboscopic detector. It should be noted that in these tests the velocity of the gas increased the velocity of the drops relative to that obtained in the absence of this gas. Specifically, in the absence of gas, this velocity was 1.3 m/s, in accordance with the tests carried out with the device 1 of the first embodiment.

The substrate 100 used had a contact angle of 40°, measured beforehand with a drop of water, and its temperature was set to 65° C.

The flow rate of the fluid coming from the reservoir 3 was 510 ml/mn. Moreover, the position of the inkjet head 10 was adjusted so that the passage cross section of the fluid between the inkjet head 10 and its housing 23' equaled 4.7 $mm^2$. This adjustment was carried out by moving the cover 203 in translation relative to the vertical wall 202.

For these tests, the distance between the nozzle 101 and the substrate 100 was between 2 mm and 3 mm. This distance was larger than in the tests carried out using the first embodiment of the device because movement of the inkjet head 10 in the conical part of the housing 23' was limited.

Lastly, the orifice 21' had the following geometrical characteristics: $h_1$=2.5 mm; $h_2$=1.5 mm; $l_2$=2.5 mm and $\alpha_1$=15°.

In contrast, the nature of the fluid coming from the reservoir 30 differed in these tests.

Specifically, the test leading to the line of ink A' was carried out with helium coming from the reservoir 30 and the test leading to the line of ink B' was carried out using hydrogen.

In both cases, the width of the lines A' and B' was about 58 μm; however, the line A' obtained with helium was slightly straighter than the line B' obtained with hydrogen.

The lines A' and B' are to be compared with the line A obtained without injecting fluid, and for the same substrate temperature of 65° C. The nozzle used to obtain the lines A' and B' was different from that used to obtain the line A. For this reason, the voltage of the piezoelectric actuator was adjusted to $V_1$=50 V in the tests used to produce the lines of ink A' and B', in order to obtain, in the absence of any gas flow, an ink drop velocity of 1.3 m/s, i.e. identical to the velocity of the ink drops in the test used to produce the line of ink A.

An improved resolution was therefore obtained, with injection of helium or hydrogen, relative to the test leading to line A. More generally, the device 1' allows similar advantages to the advantages observed with the device 1 corresponding to the first embodiment of the invention described above, to be obtained.

The device 1' of the second embodiment moreover has additional advantages over the device 1 of the first embodiment.

Thus, it is particularly advantageous to implement an effect whereby drops of ink delivered from the head 10 are driven by the gas delivered from the reservoir 30.

Specifically, in known inkjet printing devices, it sometimes proves to be necessary to increase the velocity of the ink drops.

For example, if it is desired to deposit ink on irregular target surfaces containing steps that are several hundred microns, even several millimeters, in height, the inkjet head is generally placed a relatively large distance away from the target surface. Thus, the velocity of the drops of ink is increased so that the jet of ink is not deviated by external disturbances when the head 10 is located at greater distances from the substrate 100.

To increase ink-drop velocity, known inkjet printing devices increase the voltage of the piezoelectric actuator in the inkjet head 10 if it is actuated by a piezoelectric actuator (or heating power if a thermal actuator is used in this head). This is accompanied by an increase in the diameter of the drops and therefore a decrease in the resolution of the deposit of ink thus obtained.

The device 1' of the second embodiment does not have these drawbacks.

The Applicant has carried out tests measuring the variation in the velocity of the drops delivered from the nozzle 101 as a function of the voltage $V_1$ of the piezoelectric actuator, in the absence of fluid injection, on the one hand, and with injection of fluid coming from the reservoir 30, in this case helium, on the other hand.

The results are shown in FIG. 5.

A first curve $C_1$ shows the variation in the velocity of the drops delivered from the nozzle as a function of the voltage of the piezoelectric actuator, in the absence of fluid injection.

A second curve $C_2$ shows the variation in the velocity of the drops delivered from the nozzle as a function of the voltage of the piezoelectric actuator, with injection of helium at a flow rate of 515 ml/mn. Moreover, the position of the inkjet head 10 was adjusted so that the passage cross section of the fluid between the inkjet head 10 and its housing 23' was equal to 4.7 $mm^2$.

A third curve $C_3$ shows the variation in the velocity of the drops delivered from the nozzle as a function of the voltage of the piezoelectric actuator, with injection of helium at a flow rate of 1100 ml/min. The position of the inkjet head was identical to that used for the tests resulting in curves $C_1$ and $C_2$.

The other test conditions were identical and as follows.

The ink consisted only of the solvent, namely ethylene glycol. This had no influence on the velocity of the drops of ink delivered from the nozzle 101.

The ejection nozzle used had a diameter of 80 μm and said nozzle was heated to a temperature of 47° C.

A line was formed by depositing drops in succession every 50 μm.

The nozzle was moved relative to the substrate at a speed of 450 μm/s.

The substrate 100 used had a contact angle of 40°, measured beforehand with a drop of water, and its temperature was set to 65° C.

For these tests, the distance between the nozzle 101 and the substrate 100 was between 2 mm and 3 mm. This distance was larger than in the tests carried out using the first embodiment of the device because the movement of the inkjet head 10 in the conical part of the housing 23' was limited.

As may be seen by comparing the various curves $C_1$ to $C_3$ the variation was substantially linear. In contrast, for a given voltage $V_1$, it will be noted that increasing the flow rate of helium effectively allowed the velocity of the drops to be increased.

This characterizes the driving effect whereby the drops of ink are driven by the helium flow.

The tests presented above are only examples illustrating the advantages associated with the invention. In particular, the test conditions detailed are provided in order to allow the results obtained with the device 1, I" according to the invention to be compared with a reference (absence of gas injection) under the same conditions, without however defining limiting setpoints for the operation of this device according to the invention.

The gas delivered from the reservoir may comprise an additive allowing the contact angle between the ink deposited on the substrate 100 and this substrate to be modified. For this purpose, the additive must be tailored to the substrate in question. For example, the additive may be hexadecanethiol for a substrate made of gold or comprising a superficial layer made of gold.

Thus, the contact properties between the ink and the substrate are modified. More precisely, the resolution of the deposit of ink obtained increases when the contact angle between the ink and the substrate increases.

The gas may also comprise an additive the function of which is to modify the properties of the particles contained in the ink after it has been deposited on the target surface and the solvent has evaporated.

The advantage of adding such an additive is explained below using an example.

With known devices, it is possible to deposit silver (or copper) nanoparticles on a surface using an ink containing silver (or copper) nanoparticles suspended in a solvent in order to produce, for example, a conductive line. Silver and copper oxidize in air. They can be protected from this oxidation by functionalizing them with a thiol. With these known devices, two operations must be carried out in succession. In a first operation the ink is deposited on the substrate, and in a second operation the nanoparticles contained in the ink are functionalized, after evaporation of the solvent.

In the context of the invention, adding an additive such as a thiol to the gas coming from the reservoir 30 allows a result of the same nature to be obtained in a single operation.

The process is thus much simpler to implement.

The embodiments of the invention presented above are given by way of example. Other variants may be envisioned.

In particular, the embodiments presented above comprise only one outlet orifice 21, 21' around the inkjet head 10. However, it could be envisioned to provide a plurality of outlet orifices around the head.

In particular, a plurality of inkjet heads, with one or a plurality of orifices could also be envisioned.

Finally, the device 1, I" according to the invention provides, by injecting a suitable gas into the volume located between the supporting member 20, 20' and the target surface 100, many advantages relative to known devices.

One advantage is that it is possible to print ink on cooler target surfaces i.e. on target surfaces at lower temperatures. For example, the results shown in FIG. 2 demonstrate a temperature saving of 25° C. to 30° C. for similar or even better resolution, with injection of a suitable gas.

It is thus possible to print on substrates made of polymers that cannot withstand high temperatures, while maintaining the resolution of the deposit obtained.

It is also possible to print materials, diluted in the solvent of the ink, that cannot withstand high temperatures, such as inks comprising biological compounds.

Moreover, this substrate temperature saving limits the cost of manufacturing and using the device.

In particular, in the field of nanotechnologies or microtechnologies, manufacture of the substrate carrier is made easier and the precision of its alignment is increased because thermal expansion of the latter is limited.

In addition, the lifetime of surface treatments liable to be produced on the substrate is increased. Specifically, when it is desired to deposit ink on an area smaller than the diameter of a drop, a hydrophobic region is defined around this area by photolithography and the hydrophobic zone is functionalized, for example with octadecyltrichlorosilane if the substrate is made of silicon. The deposited drops are then confined to the area inside the hydrophobic zone. However, the lifetime of this hydrophobic treatment is highly dependent on the operating temperature of the substrate. The higher the temperature of the substrate, the shorter the lifetime of the treatment.

Another advantage relates to the increase in resolution of the deposit thus obtained.

Specifically, the device 1, V allows the resolution of a line of ink deposited on a target surface to be substantially increased relative to known devices. The reader may refer, for example, to the results shown in FIG. 2.

Moreover, it is possible to choose nozzles having larger diameters than known nozzles, in order to prevent problems with blockages, without decreasing resolution.

In addition, in the particular case of the device I', the effect whereby the drops of ink are driven, generated by the velocity of the gas delivered from the reservoir 30, makes it possible to decrease the voltage of the piezoelectric actuator and/or to obtain smaller drops for higher drop velocities and/or to work with larger distances between the supporting member 20' and the target surface 100, without decreasing resolution.

In particular, this makes it possible to print ink on target surfaces comprising geometric patterns with relatively large heights. This is for example the case if it is desired to produce a conductive track between a holder and an electronic chip.

The use of such inks, having high boiling points, decreases the risk of blockage of the nozzles during phases in which the inkjet printing device is stopped and restarted.

Working under an atmosphere saturated with such a gas, such as helium or hydrogen, moreover isolates the ink from external environmental conditions and in particular from the moisture contained in ambient air. Thus, the reproducibility of the conditions under which ink is deposited on the target surface is improved.

Lastly, it should be noted that the tests presented above were carried out with either helium or hydrogen. The gases have a very low molar mass and the inventors consider them to be particularly advantageous.

However, the use of other gases, such as neon, fluorine, methane, ethane and even nitrogen ($N_2$) could be envisioned.

The invention claimed is:

1. An inkjet printing process for printing on a target surface (100), comprising the following steps:

depositing ink on the target surface with at least one inkjet head (10) placed in a chamber (60, 60'), said ink comprising a solvent that is liable to evaporate when the solvent makes contact with the target surface; and injecting a gas of a molar mass lower than the molar mass of air, the gas selected from the group consisting of hydrogen, helium, neon, fluorine, methane or ethane into the chamber (60, 60') said head being placed in this chamber so that the gas thus injected flows around the head and is then ejected out of the chamber with the ink delivered from the head.

2. The inkjet printing process as claimed in claim 1, in which the temperature of the target surface (100) is controlled.

3. The inkjet printing process as claimed in claim 1, in which the gas comprises an additive capable of modifying the contact angle between the ink deposited on the target surface and this target surface.

4. The inkjet printing process as claimed in claim 1, in which the gas comprises an additive capable functionalizing particles contained in the ink, after evaporation of the solvent from the ink.

5. The inkjet printing process as claimed in claim 1, in which the gas flow rate is controlled.

* * * * *